US007769278B2

(12) United States Patent
Kim et al.

(10) Patent No.: US 7,769,278 B2
(45) **Date of Patent: *Aug. 3, 2010**

(54) CARBON HEATER

(75) Inventors: Wan Soo Kim, Kwangmyung-si (KR); Yang Kyeong Kim, Buchun-si (KR); Young Jun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/188,781

(22) Filed: Jul. 26, 2005

(65) Prior Publication Data

US 2006/0032847 A1 Feb. 16, 2006

(30) Foreign Application Priority Data

Jul. 27, 2004 (KR) ..... 10-2004-0058664

(51) Int. Cl.
*A45D 20/40* (2006.01)
*H05B 3/10* (2006.01)
*H05B 3/08* (2006.01)

(52) U.S. Cl. ..... 392/407; 392/440; 219/541; 219/552; 219/553

(58) Field of Classification Search ..... 392/407, 392/424, 440, 422; 250/495.1, 493.1; 219/552, 219/553, 541; 313/271, 274–279
See application file for complete search history.

(56) References Cited

U.S. PATENT DOCUMENTS 2,499,961 A * 3/1950 Lennox ..... 219/541
2,523,033 A * 9/1950 Leighton ..... 313/274
3,195,002 A * 7/1965 Holcomb ..... 313/279
3,223,875 A * 12/1965 Eggers ..... 313/273
3,313,921 A * 4/1967 Heinrich et. al. ..... 219/553
3,538,374 A * 11/1970 Kane ..... 313/273
3,548,359 A 12/1970 Kuwayama et al.
3,735,328 A 5/1973 Yagi
5,925,276 A * 7/1999 Batliwalla et al. ..... 219/553
6,013,903 A * 1/2000 Mifune et al. ..... 219/552
6,057,532 A * 5/2000 Dexter et al. ..... 219/553
6,448,570 B1 * 9/2002 Scherzer et al. ..... 250/495.1
6,501,056 B1 * 12/2002 Hirohata et al. ..... 219/553
6,534,904 B1 * 3/2003 Dieudonne et al. ..... 313/271
2001/0055478 A1 12/2001 Scherzer et al.
2002/0096984 A1 * 7/2002 Konishi et al. ..... 313/25
2003/0001475 A1 * 1/2003 Halpin ..... 313/279
2003/0180034 A1 * 9/2003 Saito et al. ..... 392/407
2003/0209534 A1 * 11/2003 Ferguson ..... 219/548
2005/0047766 A1 * 3/2005 Linow et al. ..... 392/407

FOREIGN PATENT DOCUMENTS

JP 04051485 A * 2/1992
JP 05-205705 A 8/1993
JP 2002-015842 A 1/2002

* cited by examiner

*Primary Examiner*—Stephen J Ralis
(74) *Attorney, Agent, or Firm*—Birch, Stewart, Kolasch & Birch, LLP

(57) ABSTRACT

Disclosed herein is a carbon heater. The carbon heater comprises a carbon filament disposed in a tube for serving as a heating element. The carbon filament has support parts integrally formed at the carbon filament while being protruded from the carbon filament in the direction perpendicular to the longitudinal direction of the carbon filament such that the support parts are supported inside the tube. Consequently, the carbon filament is more stably supported in the tube by the support parts, whereby the service life of the carbon heater is increased, and easy and convenient design and assembly of the carbon heater is accomplished.

27 Claims, 4 Drawing Sheets

CARBON HEATER

BACKGROUND OF THE INVENTION

1. Field of the Invention

The present invention relates to a carbon heater incorporating a carbon fiber or a carbon filament, which is used as a heating element, and, more particularly, to a carbon heater having support parts, which are integrally formed at the carbon filament while being protruded from the carbon filament such that the support parts are supported inside a quartz tube.

2. Description of the Related Art

Generally, a carbon heater is a heater that uses a filament made of carbon as a heating element. As it became known that the carbon heater has excellent thermal efficiency, does not harm the environment when the carbon is discarded, and provides several effects, such as far infrared radiation, deodorization, sterilization, and antibacterial activity, the carbon heater has been increasingly used in room-heating apparatuses and drying apparatuses as well as heating apparatuses.

FIG. 1 is a perspective view schematically illustrating a conventional helical carbon heater, and FIG. 2 is a longitudinal sectional view of principal components of the conventional helical carbon heater illustrated in FIG. 1.

As shown in FIGS. 1 and 2, the conventional carbon heater comprises: a quartz tube 10 whose interior is hermetically sealed by tube sealing parts 11 disposed at both ends of the quartz tube 10; a helical carbon filament 12 arranged longitudinally in the quartz tube 10; metal wires 14 attached to both ends of the carbon filament 12 while extending to both ends of the quartz tube 10, respectively; and external electrodes 16 electrically connected to the metal wires 14 via metal pieces 18 disposed in the tube sealing parts 11 of the quartz tube 10, respectively, while being exposed to the outside of the quartz tube 10.

The interior of the quartz tube 10 is hermetically sealed, and the interior of the quartz tube 10 is maintained in vacuum or filled with an inert gas such that the carbon filament is not oxidized at a temperature of 250 to 300° C.

The carbon filament 12 is formed in a helical shape, and the metal wires 14 are connected to both ends of the carbon filament 12, respectively.

FIG. 3 is a longitudinal sectional view illustrating principal components of another conventional carbon heater incorporating a sheet-shaped carbon filament.

As shown in FIG. 3, the conventional carbon heater comprises: a sheet-shaped carbon filament 22 disposed in a quartz tube 20; carbon rods 24, for example, cylindrical graphite bars, in which both ends of the sheet-shaped carbon filament 22 are fitted, respectively; and springs 25 connected between the carbon rods 24 and metal wires 23, respectively, for providing tension forces to the carbon filament 22.

In FIG. 3, reference numeral 26 indicates external electrodes, and reference numeral 28 indicates metal pieces connected between the external electrodes 26 and the metal wires 23, respectively.

The carbon filament is formed in a helical shape as shown in FIG. 2, or the carbon filament is formed in the shape of a sheet as shown in FIG. 3, although the carbon filament may be formed in any other shape. For example, the carbon filament may be formed in the shape of a straight line, a fabric, or a sponge.

For the helical carbon filament 12 as shown in FIG. 2, both ends of the helical carbon filament 12 are tied to the metal wires 14, respectively, such that contact resistance is reduced at the connections between both ends of the helical carbon filament and the metal wires 14. For the sheet-shaped carbon filament 22 as shown in FIG. 3, both ends of the sheet-shaped carbon filament 22 cannot be tied to the metal wires 23, respectively. For this reason, a slit is formed at each carbon rod 24 such that both ends of the sheet-shaped carbon filament 22 are fitted in the slits of the carbon rods 24, respectively. Also, the springs 25 disposed at outer ends of the carbon rods 24 apply tension forces to the carbon rods 24, and thus, the carbon filament 22.

In the carbon heater as shown in FIG. 3, however, both ends of the sheet-shaped carbon filament 22 are securely fitted in the carbon rods 24, respectively, and then the carbon rods 24 are connected to the metal wires 23 by the springs 25, respectively. As a result, the carbon filament connection structure is complicated, and therefore, the whole structure of the carbon heater is complicated. Consequently, the manufacturing costs of the carbon heater are considerably increased.

Especially in the conventional carbon heater as described above, the carbon filament 22 is tensioned by the carbon rods 24, the springs 25 and the metal wires 23 disposed at both ends of the carbon filament 22, respectively, such that the carbon filament 22 is supported in the quartz tube 20. As a result, the carbon filament 22 is lengthened after the conventional carbon heater is used for a long period of time, and therefore, the carbon filament 22 comes into contact with the inside of the quartz tube 20.

SUMMARY OF THE INVENTION

Therefore, the present invention has been made in view of the above problems, and it is an object of the present invention to provide a carbon heater having support parts, which are integrally formed at a carbon filament while being protruded from the carbon filament in the direction perpendicular to the longitudinal direction of the carbon filament such that the support parts are supported inside a tube, whereby the carbon heater can be used for a long period of time with a simple carbon filament connection structure.

It is another object of the present invention to provide a carbon heater having connection conductors fitted in both ends of the carbon filament such that a connection structure between the carbon filament and electrodes is simplified, whereby easy connection between the carbon filament and the electrodes is accomplished with reduced manufacturing costs of the carbon heater.

In accordance with the present invention, the above and other objects can be accomplished by the provision of a carbon heater comprising: a carbon filament disposed in a tube for serving as a heating element, wherein the carbon filament has support parts integrally formed at the carbon filament while being protruded from the carbon filament in the direction perpendicular to the longitudinal direction of the carbon filament such that the support parts are supported inside the tube.

Preferably, the carbon filament is formed in the shape of a sheet.

Preferably, the support parts of the carbon filament are protruded from the carbon filament while being spaced apart uniformly from one another in the longitudinal direction of the carbon filament.

Preferably, the support parts of the carbon filament are arranged in bilateral symmetry with respect to the center line of the carbon filament in the longitudinal direction of the carbon filament.

Preferably, the support parts are formed in the shape of a polygon.

Preferably, the carbon heater further comprises: at least one connection conductor securely fitted in at least one end of the carbon filament such that the at least one connection conductor is connected to the at least one end of the carbon filament.

Preferably, the at least one connection conductor is formed in the shape of a sheet.

Preferably, the at least one connection conductor is formed in the shape of meshes.

Preferably, the at least one connection conductor is inserted between a plurality of stacked carbon sheets when the carbon filament is formed by pressing the plurality of stacked carbon sheets such that the stacked carbon sheets are securely attached to one another, and is then pressed together with the stacked car on sheets.

Preferably, the carbon heater further comprises: at least one metal wire having one end connected to the at least one connection conductor securely attached to the carbon filament and the other end electrically connected to at least one external electrode.

In the carbon heater with the above-stated construction according to the present invention, the connection conductors are securely fitted in both ends of the carbon filament, and support parts are integrally formed at the carbon filament while being protruded from the carbon filament in the direction perpendicular to the longitudinal direction of the carbon filament such that the support parts are supported inside the tube. Consequently, the present invention has the effect of simplifying the connection structure between the carbon filament and the external electrodes.

Furthermore, the metal conductors are securely fitted in both ends of the carbon filament such that the metal conductors are electrically connected to the carbon filament. As a result, the connection structure between the carbon filament and the external electrodes is simplified, and therefore, the connection of the external electrodes to the carbon filament is easily accomplished. Consequently, the present invention has the effect of reducing the manufacturing costs of the carbon heater.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
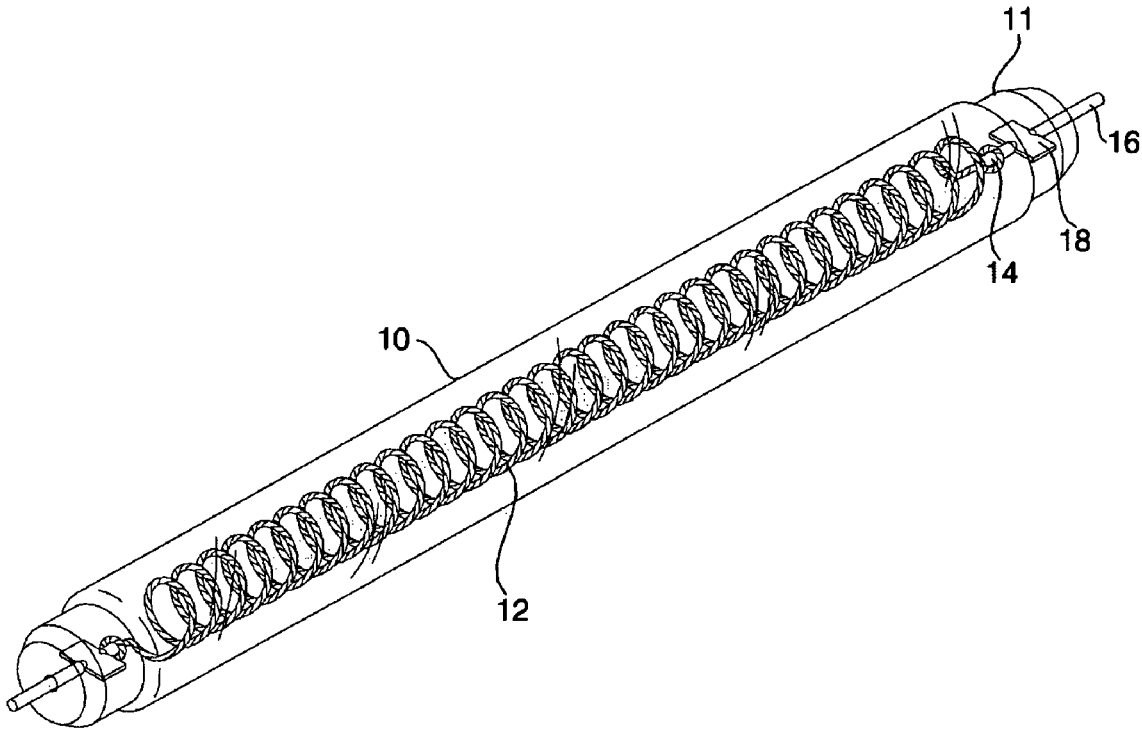
FIG. 1 (Prior Art)
FIG. 1 is a perspective view schematically illustrating a conventional helical carbon heater.
Figure 2:
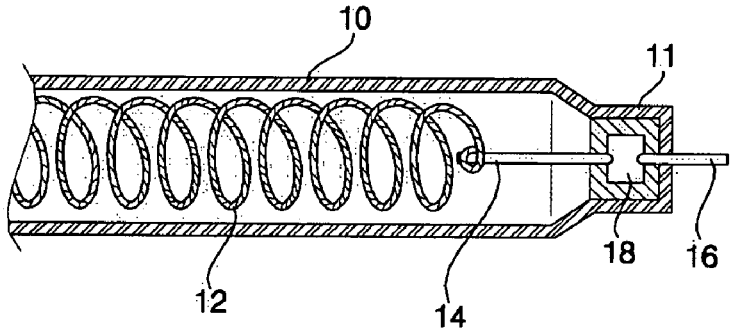
FIG. 2 (Prior Art)
FIG. 2 is a longitudinal sectional view illustrating principal components of the conventional helical carbon heater.
Figure 3:
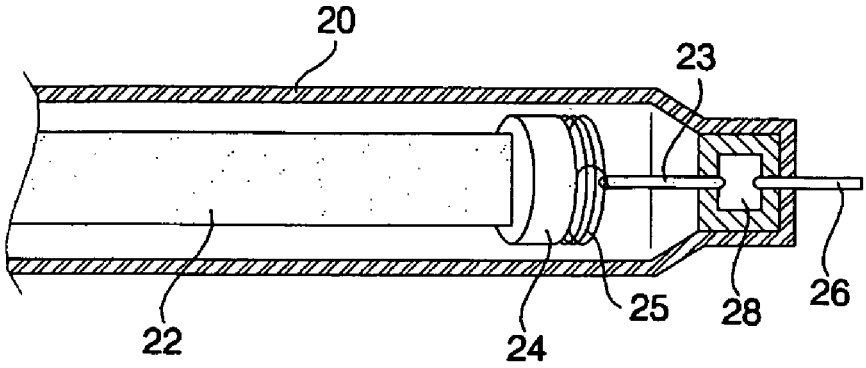
FIG. 3 (Prior Art)
FIG. 3 is a longitudinal sectional view illustrating principal components of a conventional sheet-shaped carbon heater.
Figure 4:
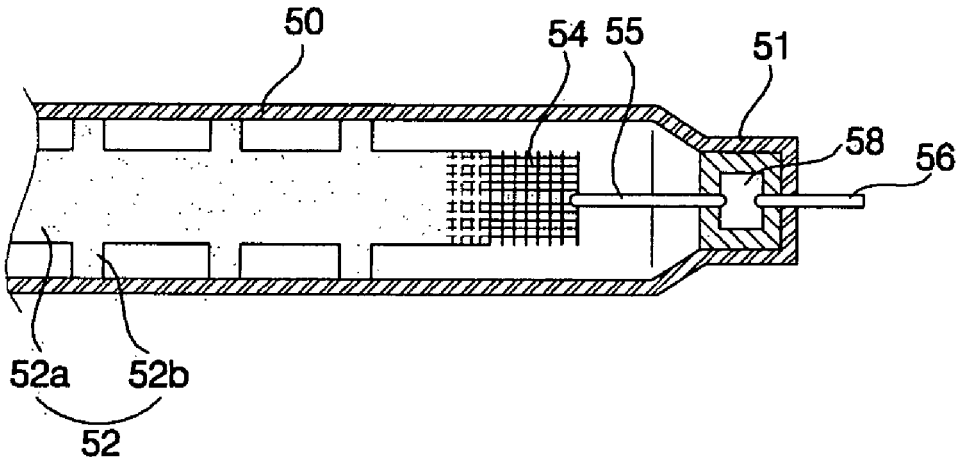
FIG. 4 is a front view, in section, illustrating principal components of a carbon heater according to a preferred embodiment of the present invention.
Figure 5:
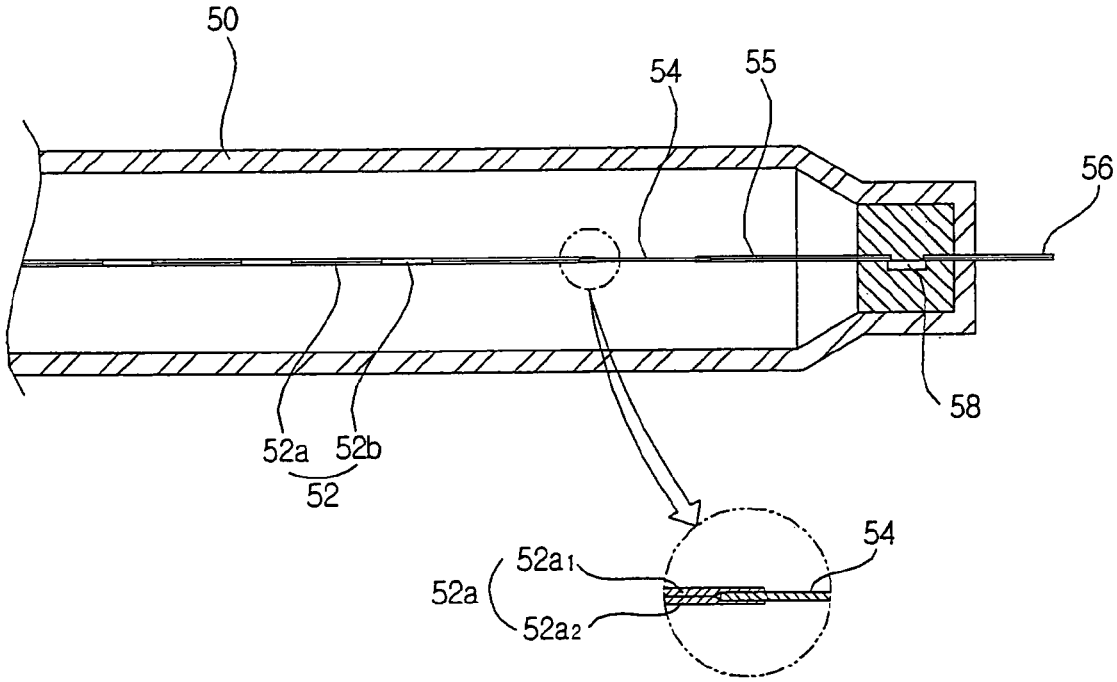
FIG. 5 is a plan view, in section, illustrating principal components of the carbon heater according to the preferred embodiment of the present invention.

FIGS. 4 and 5 show a carbon heater according to a preferred embodiment of the present invention. FIG. 4 is a front view, in section, illustrating principal components of the carbon heater according to the preferred embodiment of the present invention, and FIG. 5 is a plan view, in section, illustrating principal components of the carbon heater according to the preferred embodiment of the present invention.

As shown in FIGS. 4 and 5, the carbon heater according to the preferred embodiment of the present invention comprises: a quartz tube 50 having tube sealing parts 51 formed at both ends thereof; a carbon filament 52 disposed longitudinally in the quartz tube 50 for serving as a heating element, the carbon filament 52 being formed in the shape of a sheet; external electrodes 56 disposed at the tube sealing parts 51 of the quartz tube 50, respectively, while being exposed to the outside of the quartz tube 50; metal wires 55 connected to the external electrodes 56 via metal pieces 58 fixed to the tube sealing parts 51 at both ends of the quartz tube 50, respectively; and connection conductors 54 connected between both ends of the carbon filament 52 and the metal wires 55, respectively.

The quartz tube 50 is constructed such that the interior of the quartz tube 50 is hermetically sealed while the interior of the quartz tube 50 is maintained in vacuum or filled with an inert gas. Preferably, the tube is made of quartz, although materials for the tube are not restricted. For example, any tube having sufficient thermal resistance and strength, such as a special glass tube, may be used.

The carbon filament 52 is formed by pressing a plurality of stacked carbon sheets such that the stacked carbon sheets are securely attached to one another.

The carbon filament 52 comprises: a heating part 52a disposed longitudinally in the quartz tube 50 for performing a heating operation when the heating part 52*a* is supplied with electric current; and support parts 52*b* integrally formed at the heating part 52*a* while being protruded from both lateral sides of the heating part 52*a* in the direction perpendicular to the longitudinal direction of the carbon filament 52 such that the support parts 52*b* are supported inside the quartz tube 50.

The support parts 52*b* are integrally formed at the heating part 52*a* while being protruded from the heating part 52*a*. Preferably, each support part 52*b* is formed in the shape of a square or a rectangle as shown in FIG. 4, although each support part 52*b* may be formed in any other shape as shown in FIGS. 6 to 9.

Figure 6:
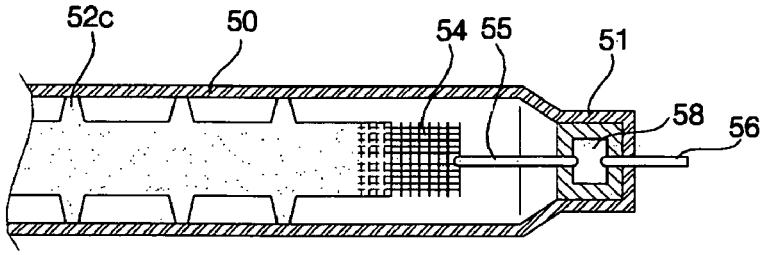
FIGS. 6 to 9 are longitudinal sectional views respectively illustrating principal components of carbon heaters according to other preferred embodiments of the present invention.
Figure 7:
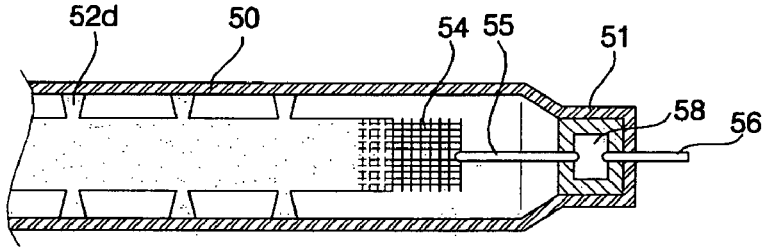
Figure 8:
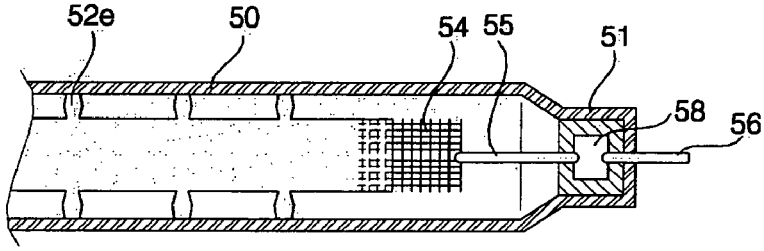
Figure 9:
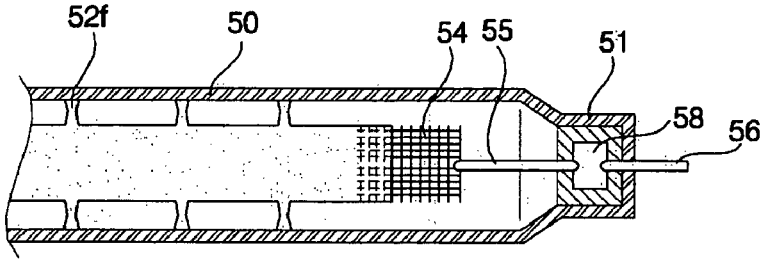

For example, the carbon filament 52 may include support parts 52*c*, each of which is formed in a trapezoidal shape as shown in FIG. 6, support parts 52*d*, each of which is formed in an inverse trapezoidal shape as shown in FIG. 7, support parts 52*e*, each of which is formed in the shape of a polygon whose middle is convex as shown in FIG. 8, or support parts 52*f*, each of which is formed in the shape of a polygon whose middle is concave as shown in FIG. 9. In addition, other various modifications of the support parts are also possible based on design conditions, such as heat transfer or rigidity, and requirement.

Preferably, the above-mentioned support parts 52*b*, 52*c*, 52*d*, 52*e*, and 52*f* are arranged in bilateral symmetry with respect to the center line of the carbon filament 52 in the longitudinal direction of the carbon filament 52.

The metal wires 55, each made of a metal material, are securely fixed to the respective connection conductors 54 by welding such that the metal wires 55 are electrically connected to the connection conductors 54, respectively.

Each of the connection conductors 54 is a thin metal sheet formed in the shape of meshes. The connection conductors 54 are securely fitted in both ends of the carbon filament 52. In this way, the connection conductors 54 are connected to the carbon filament 52.

Specifically, each of the connection conductors 54 is inserted between a plurality of stacked carbon sheets when the carbon filament 52 is formed by pressing the plurality of stacked carbon sheets such that the stacked carbon sheets are securely attached to one another, and is then pressed together with the stacked carbon sheets. As a result, the connection conductors 54 are securely attached to both ends of to the carbon filament 52, respectively.

In the above, the sheet-shaped carbon filament 52 has been illustrated and described, although the shape of the carbon filament 52 may be formed in any other shape without limits. For example, the carbon filament 52 may be formed in the shape of a helical line, a straight line, a fabric, or a sponge, based on design conditions. It is also possible to form the above-mentioned support parts integrally at the various shaped carbon filament 52.

Now, the operation of the carbon heater with the above-stated construction according to the present invention will be described.

The carbon filament 52 is formed by pressing a plurality of stacked carbon sheets such that the stacked carbon sheets are securely attached to one another. At this time, the pressing operation of the stacked carbon sheets is carried out while the connection conductors 54 are inserted between the stacked carbon sheets at both ends of the carbon filament 52. In this way, the connection conductors 54 are securely attached to both ends of to the carbon filament 52, respectively.

After the connection conductors 54 are connected to the carbon filament 52, the metal wires 55 are securely attached to the respective connection conductors 54, for example, by welding. In this way, the metal wires 55 are connected to the connection conductors 54, respectively.

After the connection conductors 54 and the metal wires 55 are connected to both ends of the carbon filament 52, respectively, as described above, the carbon filament 52 is inserted into the quartz tube 50, and then the tube sealing parts 51 are closed such that the interior of the quartz tube 50 is hermetically sealed by the closed tube sealing parts 51. Subsequently, the external electrodes 56 are connected to the respective metal pieces 58, which are also connected to the metal wires 55, respectively. In this way, disposition of the carbon filament 52 in the quartz tube 50 is completed.

At this time, the support parts 52*b* of the carbon filament 52 are protruded from both lateral sides of the heating part 52*a* of the carbon filament 52 while being spaced apart uniformly from one another in the longitudinal direction of the carbon filament 52 such that the support parts 52*b* are supported inside the quartz tube 50. As a result, the carbon filament 52 is not deformed even after the carbon filament 52 is used for a long period of time, and therefore, the carbon filament 52 is stably supported in the quartz tube 50. Consequently, damage to the carbon filament 52 is minimized, and therefore, the service life of the carbon heater is increased.

Also, the support part 52*b* of the carbon filament 52 is integrally formed at the heating part 52*a* of the carbon filament 52, and therefore, the carbon filament 52 is easily manufactured. Furthermore, the support part 52*b* of the carbon filament 52 stably support the heating part 52*a* of the carbon filament in the quartz tube 50, and therefore, design and assembly for interconnection between the connection conductors 54 and the corresponding metal wires 55, which strain the carbon filament 52 at both ends of the carbon filament 52, respectively, are more easily and conveniently accomplished.

As apparent from the above description, the carbon heater according to the present invention is characterized in that the connection conductors are securely fitted in both ends of the carbon filament, and support parts are integrally formed at the carbon filament while being protruded from the carbon filament in the direction perpendicular to the longitudinal direction of the carbon filament such that the support parts are supported inside the tube. Consequently, the present invention has the effect of simplifying the connection structure between the carbon filament and the external electrodes.

Also, the carbon filament is more stably supported in the tube by the support parts of the carbon filament. Consequently, the present invention has the effect of increasing the service life of the carbon heater and accomplishing easy and convenient design and assembly of the carbon heater.

Furthermore, the metal conductors are securely fitted in both ends of the carbon filament such that the metal conductors are electrically connected to the carbon filament. As a result, the connection structure between the carbon filament and the external electrodes is simplified, and therefore, the connection of the external electrodes to the carbon filament is easily accomplished. Consequently, the present invention has the effect of reducing the manufacturing costs of the carbon heater.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A carbon heater comprising:

a carbon filament disposable in a tube for serving as a heating element, the carbon filament having a main body having a first outermost lateral sidewall surface and a second outermost lateral sidewall surface, the second outermost lateral sidewall surface being opposite to the first outermost lateral sidewall surface, and a plurality of support parts, the support parts respectively extending from the first outermost lateral sidewall surface and the second outermost lateral sidewall surface of the main body to the inner circumferential surface of the tube in a direction perpendicular to a longitudinal direction of the carbon filament, such that the support parts are supportable inside the tube, wherein a combination of the main body and the support parts of the carbon filament is an integral, unitary structure made of a same material and is formed in the shape of a sheet, and the main body and the support parts are co-planar and have a same uniform thickness throughout an entire co-planar plane;

wherein a width of each of the support parts in a longitudinal direction of the tube and in the longitudinal direction of the carbon filament becomes smaller from the outermost lateral sidewall of the main body to the inner circumferential surface of the tube, the width of each of the support parts being defined as a length from one outermost end of a corresponding one of the support parts in the longitudinal direction of the tube and in the longitudinal direction of the carbon filament to an opposite outermost end of the corresponding one of the support parts in the longitudinal direction of the tube and in the longitudinal direction of the carbon filament, wherein the entire width of each of the entire support parts is filled with the material of each of the support parts, and wherein the support parts are not in contact with each other.

2. The carbon heater as set forth in claim 1, wherein the support parts of the carbon filament are spaced apart uniformly from one another in the longitudinal direction of the carbon filament.

3. The carbon heater as set forth in claim 1, wherein the support parts of the carbon filament are arranged in bilateral symmetry with respect to the center line of the carbon filament in the longitudinal direction of the carbon filament.

4. The carbon heater as set forth in claim 1, further comprising:

at least one metal wire having one end connected to at least one connection conductor securely attached to the carbon filament and the other end electrically connected to at least one external electrode.

5. The carbon heater as set forth in claim 1, wherein a thickness of the support parts is substantially the same as a thickness of the main body of the carbon filament.

6. The carbon heater as set forth in claim 1, wherein the support parts and the main body are substantially coplanar.

7. The carbon heater as set forth in claim 1, wherein the width of each of the support parts in the longitudinal direction of the tube and in the longitudinal direction of the carbon filament becomes continuously smaller from the outermost lateral sidewall of the main body to the inner circumferential surface of the tube.

8. The carbon heater as set forth in claim 1, wherein at least one of the one outermost end and the opposite outermost end of each of the support parts in the longitudinal direction of the tube and in the longitudinal direction of the carbon filament is slantingly linear.

9. The carbon heater as set forth in claim 1, further comprising the tube, the filament being disposed in the tube.

10. The carbon heater as set forth in claim 9, wherein a width of the filament is substantially the same as a width of the tube.

11. The carbon heater as set forth in claim 1, further comprising:

at least one connection conductor securely fitted in at least one end of the carbon filament such that the at least one connection conductor is connected to the at least one end of the carbon filament.

12. The carbon heater as set forth in claim 11, wherein the carbon filament comprises a plurality of stacked carbon sheets pressed together with one end of the at least one connection conductor inserted between the plurality of stacked carbon sheets such that the stacked carbon sheets and the at least one connection conductor are securely attached each other.

13. The carbon heater as set forth in claim 11, wherein the at least one connection conductor is formed in the shape of a sheet.

14. The carbon heater as set forth in claim 13, wherein the at least one connection conductor is formed in the shape of meshes.

15. A carbon heater comprising:

a tube;

a carbon filament disposed in the tube for serving as a heating element, the carbon filament having a main body having a first outermost lateral sidewall surface and a second outermost lateral sidewall surface, the second outermost lateral sidewall surface being opposite to the first outermost lateral sidewall surface, and a plurality of support parts, the support parts respectively extending from the first outermost lateral sidewall surface and the second outermost lateral sidewall surface of the main body to the inner circumferential surface of the tube in a direction perpendicular to a longitudinal direction of the carbon filament, such that the support parts are supportable inside the tube; and at least one connection conductor securely fitted in at least one end of the carbon filament, the at least one connection conductor being connected to at least one metal wire, which is electrically connected to at least one external electrode, wherein a combination of the main body and the support parts of the carbon filament is an integral, unitary structure made of a same material and is formed in the shape of a sheet, and the main body and the support parts are co-planar and have a same uniform thickness throughout an entire co-planar plane, wherein a width of each of the support parts in a longitudinal direction of the tube and in the longitudinal direction of the carbon filament becomes smaller from the outermost lateral sidewall of the main body to the inner circumferential surface of the tube, the width of each of the support parts being defined as a length from one outermost end of a corresponding one of the support parts in the longitudinal direction of the tube and in the longitudinal direction of the carbon filament to an opposite outermost end of the corresponding one of the support parts in the longitudinal direction of the tube and in the longitudinal direction of the carbon filament, wherein the entire width of each of the entire support parts is filled with the material of each of the support parts, and wherein the support parts are not in contact with each other.

16. The carbon heater as set forth in claim 15, wherein the support parts of the carbon filament are spaced apart uniformly from one another in the longitudinal direction of the carbon filament.

17. The carbon heater as set forth in claim 15, wherein the support parts of the carbon filament are arranged in bilateral symmetry with respect to the center line of the carbon filament in the longitudinal direction of the carbon filament.

18. The carbon heater as set forth in claim 15, wherein an entire cross-section of an interior of the tube is circular.

19. The carbon heater as set forth in claim 15, wherein the width of each of the support parts in the longitudinal direction of the tube and in the longitudinal direction of the carbon filament becomes continuously smaller from the outermost lateral sidewall of the main body to the inner circumferential surface of the tube.

20. The carbon heater as set forth in claim 15, wherein at least one of the one outermost end and the opposite outermost end of each of the support parts in the longitudinal direction of the tube and in the longitudinal direction of the carbon filament is slantingly linear.

21. The carbon heater as set forth in claim 15, wherein the at least one connection conductor is formed in the shape of a sheet.

22. The carbon heater as set forth in claim 21, wherein the at least one connection conductor is formed in the shape of meshes.

23. The carbon heater as set forth in claim 21, wherein the carbon filament comprises a plurality of stacked carbon sheets pressed together with one end of the at least one connection conductor inserted between the plurality of stacked carbon sheets such that the stacked carbon sheets are securely attached to one another.

24. A carbon heater comprising:

a carbon filament sheet disposable in a tube for serving as a heating element, the carbon filament having a main body having a first outermost lateral sidewall surface and a second outermost lateral sidewall surface, the second outermost lateral sidewall surface being opposite to the first outermost lateral sidewall surface, and a plurality of support parts, the support parts respectively extending from the first outermost lateral sidewall surface and the second outermost lateral sidewall surface of the main body to the inner circumferential surface of the tube in a direction perpendicular to a longitudinal direction of the carbon filament, such that the support parts are supportable inside the tube; and at least one straight connection conductor mesh securely fitted in at least one end of the carbon filament, the at least one straight connection conductor mesh being connected to at least one straight metal wire, which is electrically connected to at least one external electrode, wherein a combination of the main body and the support parts of the carbon filament is an integral, unitary structure made of a same material and is formed in the shape of a sheet, and the main body and the support parts are co-planar and have a same uniform thickness throughout an entire co-planar plane, wherein a width of each of the support parts in a longitudinal direction of the tube and in the longitudinal direction of the carbon filament becomes smaller from the outermost lateral sidewall of the main body to the inner circumferential surface of the tube, the width of each of the support parts being defined as a length from one outermost end of a corresponding one of the support parts in the longitudinal direction of the tube and in the longitudinal direction of the carbon filament to an opposite outermost end of the corresponding one of the support parts in the longitudinal direction of the tube and in the longitudinal direction of the carbon filament, wherein the entire width of each of the entire support parts is filled with the material of each of the support parts, and wherein the support parts are not in contact with each other.

25. The carbon heater as set forth in claim 24, wherein the carbon filament comprises a plurality of stacked carbon sheets pressed together with one end of the at least one connection conductor mesh inserted between the plurality of stacked carbon sheets such that the stacked carbon sheets are securely attached to one another.

26. The carbon heater as set forth in claim 24, wherein the width of each of the support parts in the longitudinal direction of the tube and in the longitudinal direction of the carbon filament becomes continuously smaller from the outermost lateral sidewall of the main body to the inner circumferential surface of the tube.

27. The carbon heater as set forth in claim 24, wherein at least one of the one outermost end and the opposite outermost end of each of the support parts in the longitudinal direction of the tube and in the longitudinal direction of the carbon filament is slantingly linear.

* * * * *